US006435184B1

(12) United States Patent
Ho

(10) Patent No.: US 6,435,184 B1
(45) Date of Patent: Aug. 20, 2002

(54) GAS MASK STRUCTURE

(76) Inventor: Tien Lu Ho, No. 407, Keng Yuan Rd., Tung Hu Li, Ta Li, Taichung Hsien (TW)

( * ) Notice: Subject to any disclaimer, the term of this patent is extended or adjusted under 35 U.S.C. 154(b) by 62 days.

(21) Appl. No.: 09/653,693

(22) Filed: Sep. 1, 2000

(51) Int. Cl.[7] ..... A62B 18/02
(52) U.S. Cl. ..... 128/206.21; 128/206.28
(58) Field of Search ..... 128/201.23–201.25, 128/201.28, 205.25, 205.27, 205.28, 206.12–206.15, 206.17–206.19, 207.11–207.13, 206.21, 206.24, 206.27, 206.28, 201.22

(56) References Cited

U.S. PATENT DOCUMENTS

| | | | | | |
|---|---|---|---|---|---|
| 908,108 | A | * | 12/1908 | Knudsen | 128/206.21 |
| 3,683,907 | A | * | 8/1972 | Cotabish | 128/200.28 |
| 4,227,520 | A | * | 10/1980 | Lord | 128/201.24 |
| 4,336,799 | A | * | 6/1982 | Almasi et al. | 128/201.24 |
| 4,462,399 | A | * | 7/1984 | Braun | 128/201.24 |
| 4,549,542 | A | * | 10/1985 | Chien | 128/201.24 |
| 4,730,612 | A | * | 3/1988 | Dampney | 128/201.24 |
| 4,886,056 | A | * | 12/1989 | Simpson | 128/201.25 |
| 5,035,239 | A | * | 7/1991 | Edwards | 128/200.28 |
| 5,113,853 | A | * | 5/1992 | Dickey | 128/200.28 |
| 5,283,914 | A | * | 2/1994 | James | 128/201.24 |
| H1360 | H | * | 10/1994 | Grove et al. | 128/201.23 |
| 5,372,130 | A | * | 12/1994 | Stern et al. | 128/205.25 |
| 5,394,870 | A | * | 3/1995 | Johansson | 128/201.25 |
| 5,533,500 | A | * | 7/1996 | Her-Mou | 128/201.24 |
| 5,555,879 | A | * | 9/1996 | Helin et al. | 128/200.28 |
| 5,562,092 | A | * | 10/1996 | George | 128/201.25 |
| 5,592,936 | A | * | 1/1997 | Thomas et al. | 128/201.24 |
| 5,623,923 | A | * | 4/1997 | Bertheau et al. | 128/201.22 |
| 5,662,101 | A | * | 9/1997 | Ogden et al. | 128/202.27 |
| 5,848,592 | A | * | 12/1998 | Sibley | 128/200.11 |
| 5,906,203 | A | * | 5/1999 | Klockseth et al. | 128/201.25 |
| 6,041,778 | A | * | 3/2000 | Swann et al. | 128/201.25 |
| 6,050,262 | A | * | 4/2000 | Jay | 128/205.12 |
| 6,192,886 | B1 | * | 2/2001 | Rudolph | 128/205.25 |
| 6,298,849 | B1 | * | 10/2001 | Scholey et al. | 128/205.27 |

FOREIGN PATENT DOCUMENTS

| | | | |
|---|---|---|---|
| EP | 0164946 | * | 12/1985 |
| GB | 2221164 | * | 1/1990 |

* cited by examiner

*Primary Examiner*—John G. Weiss
*Assistant Examiner*—Teena Mitchell
(74) *Attorney, Agent, or Firm*—Rosenberg, Klein & Lee

(57) ABSTRACT

A gas mask structure including a rear cup body, two cell seats and a front cup body. The rear cup body has an opening facing backward. A top side of front face of the rear cup body is formed with an inlet and a guide way downward extends from the inlet. An inclined outlet is formed on a bottom side of front face of the rear cup body. A check membrane is disposed on front side of the outlet. The cell seats are respectively disposed on two sides of the bottom of the rear cup body for receiving cells therein to provide power for a motor to drive a fan. The front cup body is fixedly disposed on lower side of the front end of the rear cup body. A filter body is positioned in a fixing seat of the front cup body. A cover body is screwed on the fixing seat to fix the filter body therein and tightly hold a second filter body in front of the filter body. An inner face of the fixing seat is formed with a through hole in which the motor and the fan are disposed. The fan serves to generate air flow which is filtered through the second filter body and the filter body and then conducted into the guide way of the rear cup body.

3 Claims, 7 Drawing Sheets

GAS MASK STRUCTURE

BACKGROUND OF THE INVENTION

The present invention relates to an improved gas mask structure, and more particularly to a gas mask having shorter length and is equipped with a second filter body disposed in front of the filter body for filtering off larger particles such as dust and powder.

FIG. 5 shows a conventional gas mask used in spraying of agricultural chemicals. The gas mask includes a helmet (not shown) and a respiratory cup 81 for a user to wear on the nose and mouth. The respiratory cup 81 is connected with one end of a respiratory tube 82. The other end of the respiratory tube 82 is connected with a filter unit 8 having a filter body and a blower (not shown). The blower sucks in air and makes the air filter through the filter body and go through the respiratory tube 82 to the respiratory cup 81 for the user to breathe clean and cool air. However, in practical use, such gas mask still has some shortcomings as follows:

1. Inconvenience in use: The filter unit 8 is worn on the waist of the user and the air is conducted through the respiratory tube 82 to the respiratory cup 81. However, the distance from the waist to the nose and mouth is considerably long. Moreover, in order to permit the user's head and body to more freely move, the respiratory tube 82 must be even longer. In a narrow space, the long respiratory tube 82 will obstruct the user from working. Especially, when spraying the agricultural chemicals, the user must carry a spraying equipment. Under such circumstance, the long respiratory tube 82 will lead to great inconvenience in use.
2. Great pressure loss of the respiratory tube: The respiratory tube 82 is in a winding state. This leads to pressure loss of the flowing air and results in low efficiency of the blower and waste of energy.
3. Heavy equipment: The conventional gas mask has numerous components including helmet, respiratory tube cup 81, respiratory tube 82 and filter unit 8 and is quite heavy. In addition, the long respiratory tube 82 must be co-used with a blower with greater power for sending air with sufficient pressure. Therefore, generally, the blower often cooperates with a chargeable battery (not shown). Such battery is very heavy and makes it more inconvenient to use the gas mask.

In order to eliminate the above shortcomings of the conventional gas mask, an improved gas mask as shown in FIGS. 6 and 7 has been developed. A motor 91 and a fan 92 are disposed in a front cup body 9 of the gas mask for directly sucking air. A filter body 93 serves to filter off the harmful materials entrained by the air and directly send the air to a rear cup 94 for a user to breathe. Accordingly, the power of the motor 91 will not be lost so that the working efficiency of the motor 91 and the fan 92 is increased. In addition, such gas mask can be directly worn on the face without intervening with the movement of other parts of a user's body. However, in practical use of such gas mask in different working sites, for example, in the working site of a carpenter, wooden chips and powder are often produced, which tend to block the filter body 93 made of activated carbon. Under such circumstance, the filter body 93 will lose its normal function and must be frequently replaced with a new one. The activated carbon-made filter body 93 is manufactured at high cost so that a lot of money will be expensed.

Moreover, a check membrane 95 is horizontally disposed on the bottom of the rear cup 94 for conveniently breathing. The check membrane 95 has a considerable width which elongates the length of the rear cup 94. In addition, the cells 97 in the cell seat 96 are also horizontally positioned so that the entire length of the gas mask is increased. As a result, when wearing such gas mask, the filter body 93 is far spaced from the user's face. This increases the torque and makes the user feel heavier to wear the gas mask. For shortening the length, the number of the cells 97 must be reduced. However, this will lead to insufficient power and make it necessary to frequently replace the cells 97.

SUMMARY OF THE INVENTION

It is therefore a primary object of the present invention to provide an improved gas mask structure having a second filter body disposed in front of the filter body. A cover body is screwed on a fixing seat of the front cup body to fix the filter body therein and tightly hold the second filter body. The second filter body serves to filter off larger particles such as dust and powder so as to prevent the filter body from being blocked thereby. Therefore, the using life of the filter body is prolonged and the cost is reduced.

It is a further object of the present invention to provide the above gas mask structure from which the second filter body can be removed for use in different working sites.

It is still a further object of the present invention to provide the above gas mask structure having shorter length so that the torque of the front end of the gas mask is reduced and a user can more comfortably wear the gas mask.

The present invention can be best understood through the following description and accompanying drawings wherein:

DETAILED DESCRIPTION OF THE PREFERRED EMBODIMENT

Figure 1:
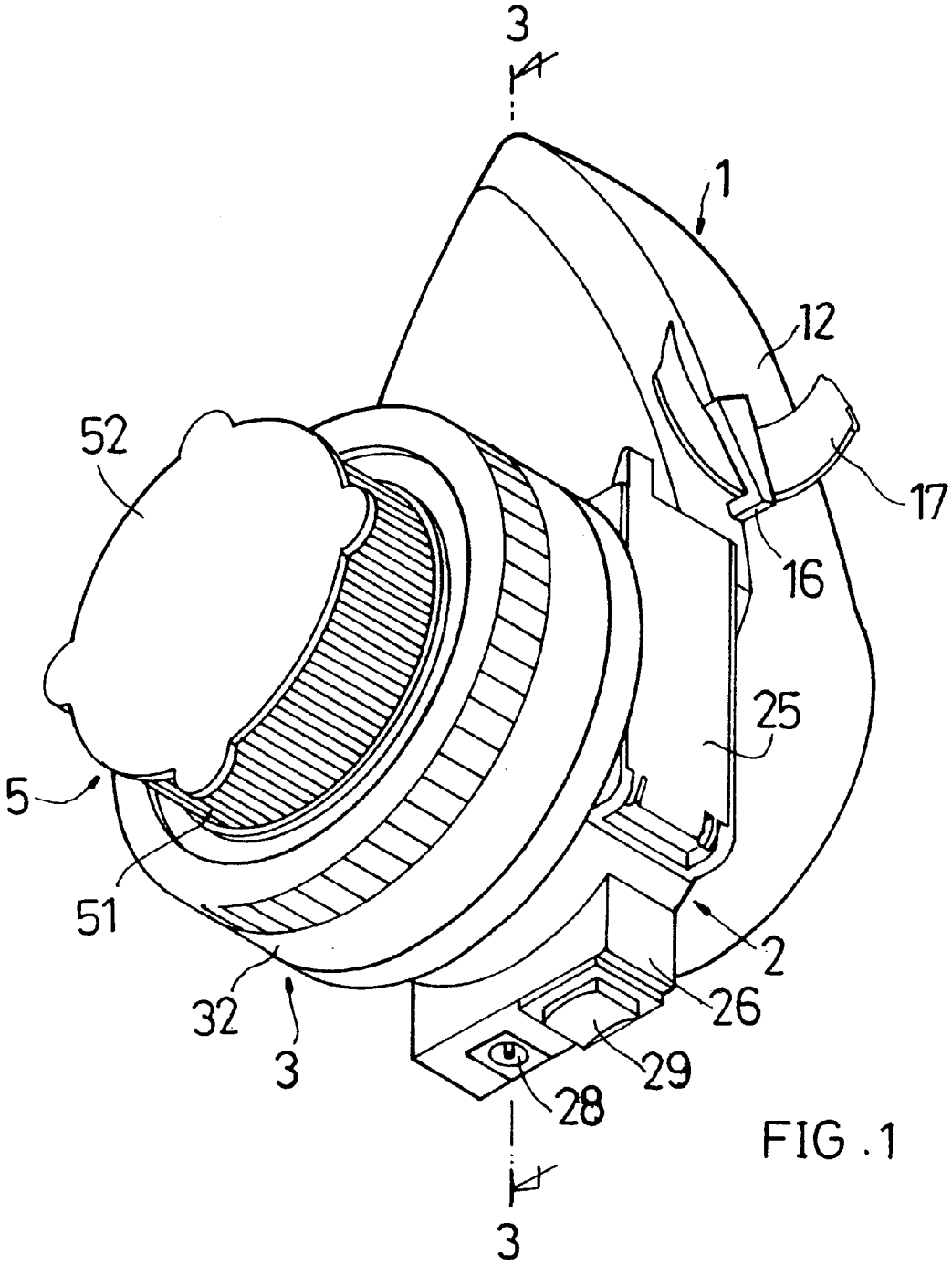
FIG. 1 is a perspective assembled view of the present invention.
Figure 2:
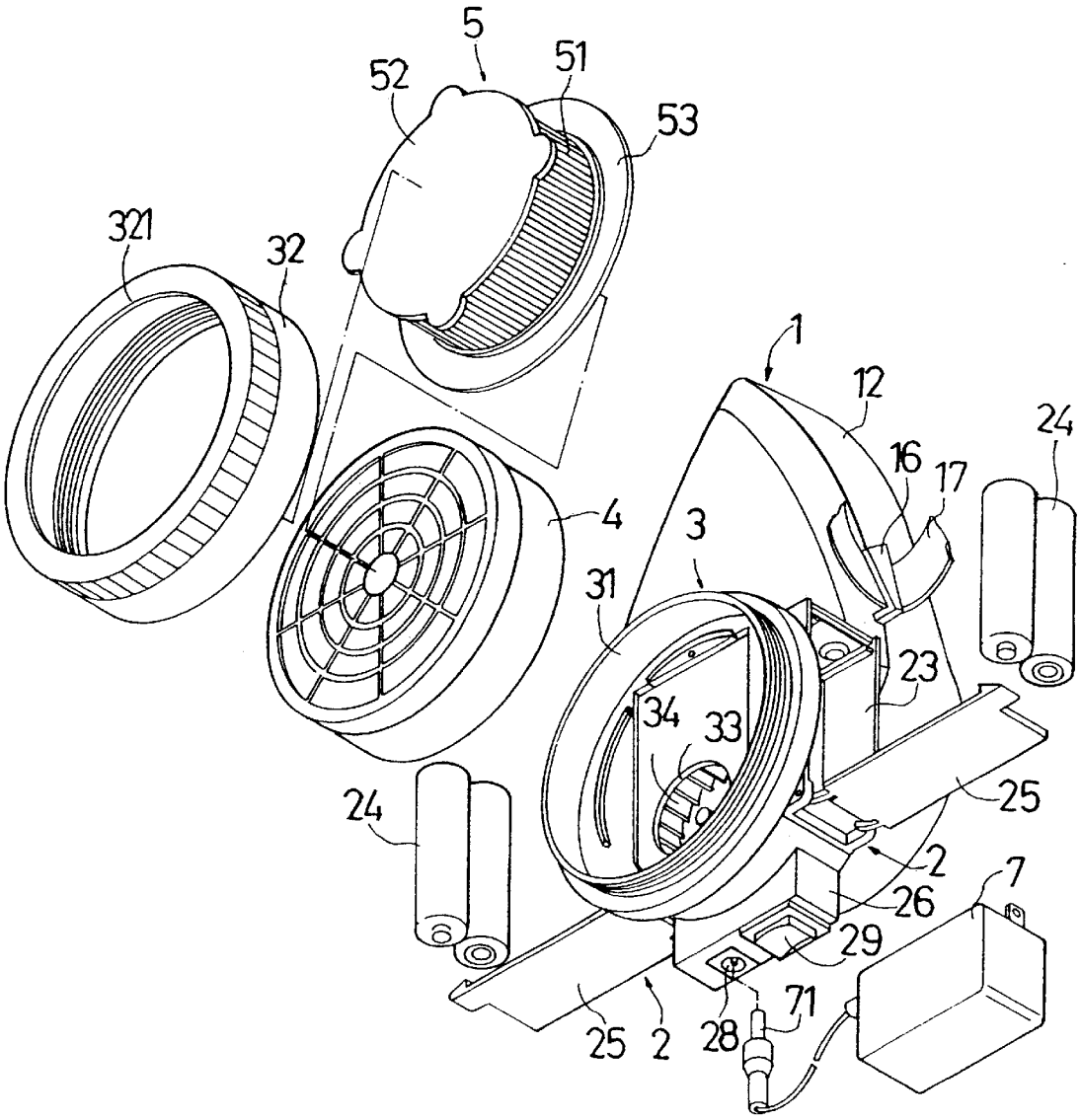
FIG. 2 is a perspective exploded view of the present invention.

Please refer to FIGS. 1 to 4. The present invention includes:

a rear cup body 1 having an opening 11 facing backward, an annular sealing pad 12 being fitted with the periphery of the opening 11, the sealing pad 12 being made of soft rubber material, a top side of front face of the rear cup body 1 being formed with an inlet 13, a guide way 131 downward extending from the inlet 13, an inclined outlet 14 being formed on a bottom side of front face of the rear cup body 1, a slope face of the outlet 14 being directed to rear upper side, a check membrane 15 being disposed on front side of the outlet 14, two ear sections 16 being respectively disposed on left and right sides of the rear cup body 1 for connecting with a strap 17;

two cell seats 2 respectively disposed on two sides of the bottom of the rear cup body 1, an air exit 22 being formed between the two cell seats 2 for discharging air from the outlet 14 of the rear cup body 1, each cell seat 2 having a recessed receiving chamber 23 opposite to the other for receiving two cells 24 therein, an outer cover 25 being disposed on an opening of the receiving chamber 23, a retaining seat 26 being formed between the bottom edges of the two cell seats 2, a motor 27 powered by the cells 24 being disposed in the cell seats 2, a main shaft of the motor 27 extends forward, a charging seat 28 and a power switch 29 for controlling power supplied by the cells 24 being disposed on the bottom of the retaining seat 26, the charging seat 28 being adapted for receipt of a plug 71 of a charger 7 to plug therein for charging; and a front cup body 3 fixedly disposed on lower side of the front end of the rear cup body 1, a front end of the front cup body 3 being formed with a circular fixing seat 31, a circular activated carbon-made filter body 4 being positioned in the fixing seat 31, a ring-shaped cover body 32 being screwed on the fixing seat 31 to fix the filter body 4 therein, a front side of the cover body 32 being formed with a flange 321, a second filter body 5 being disposed on front side of the filter body 4, the second filter body 5 having a filter layer 51 made of unwoven fabric or folded fiber-made filter paper, a protective cover 52 being disposed on front side of the filter layer 51, the rear side of the filter layer 51 being formed with a flange 53 inlaid in the flange 321 of the cover body 32, an inner face of the fixing seat 31 being formed with a through hole 33 in which a fan 34 is disposed, the fan 34 being connected with the motor 27 in the retaining seat 26 for generating air flow which is conducted into the guide way 131 of the rear cup body 1.

Figure 3:
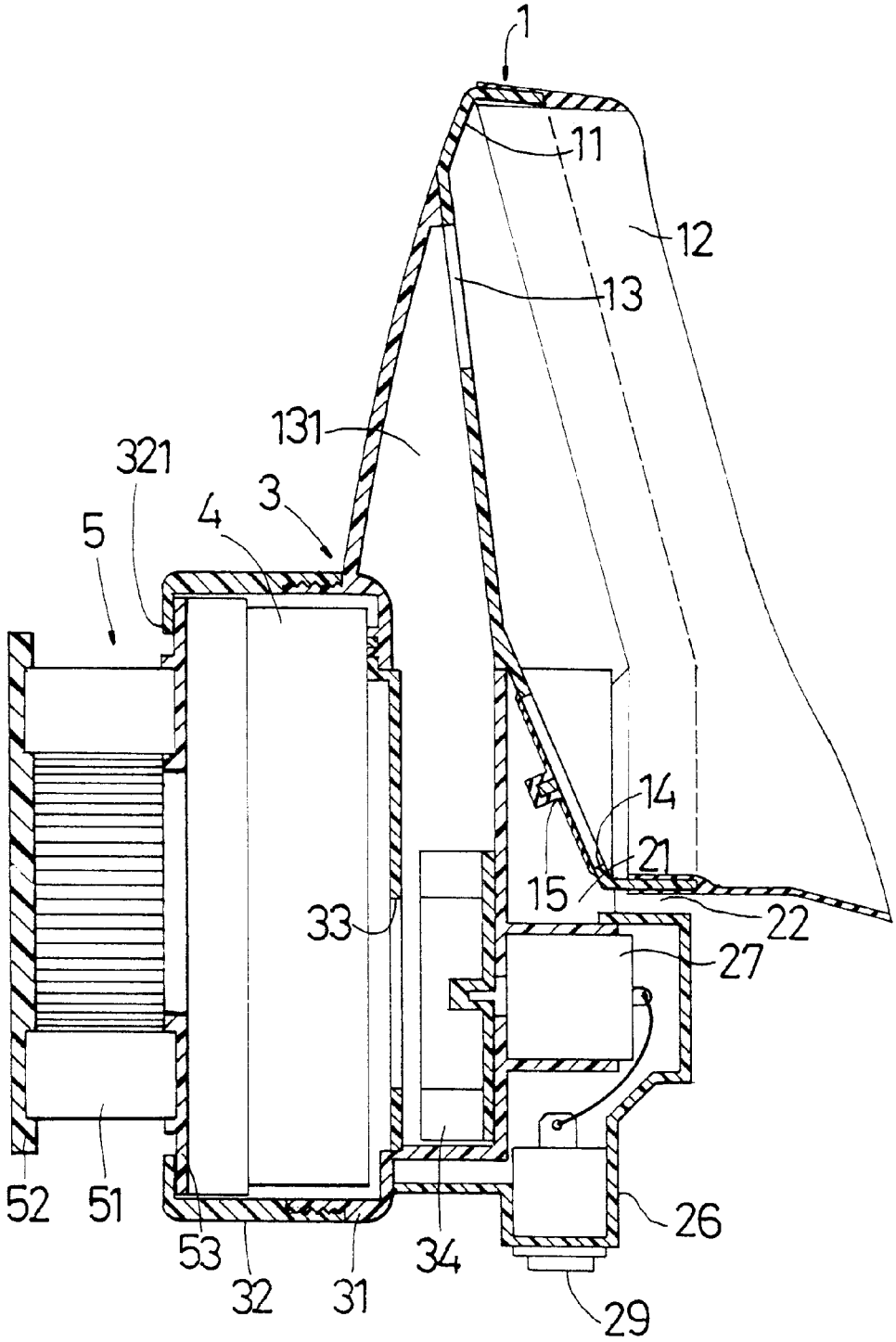
FIG. 3 is a sectional view taken along line III—III of FIG. 1.
Figure 4:
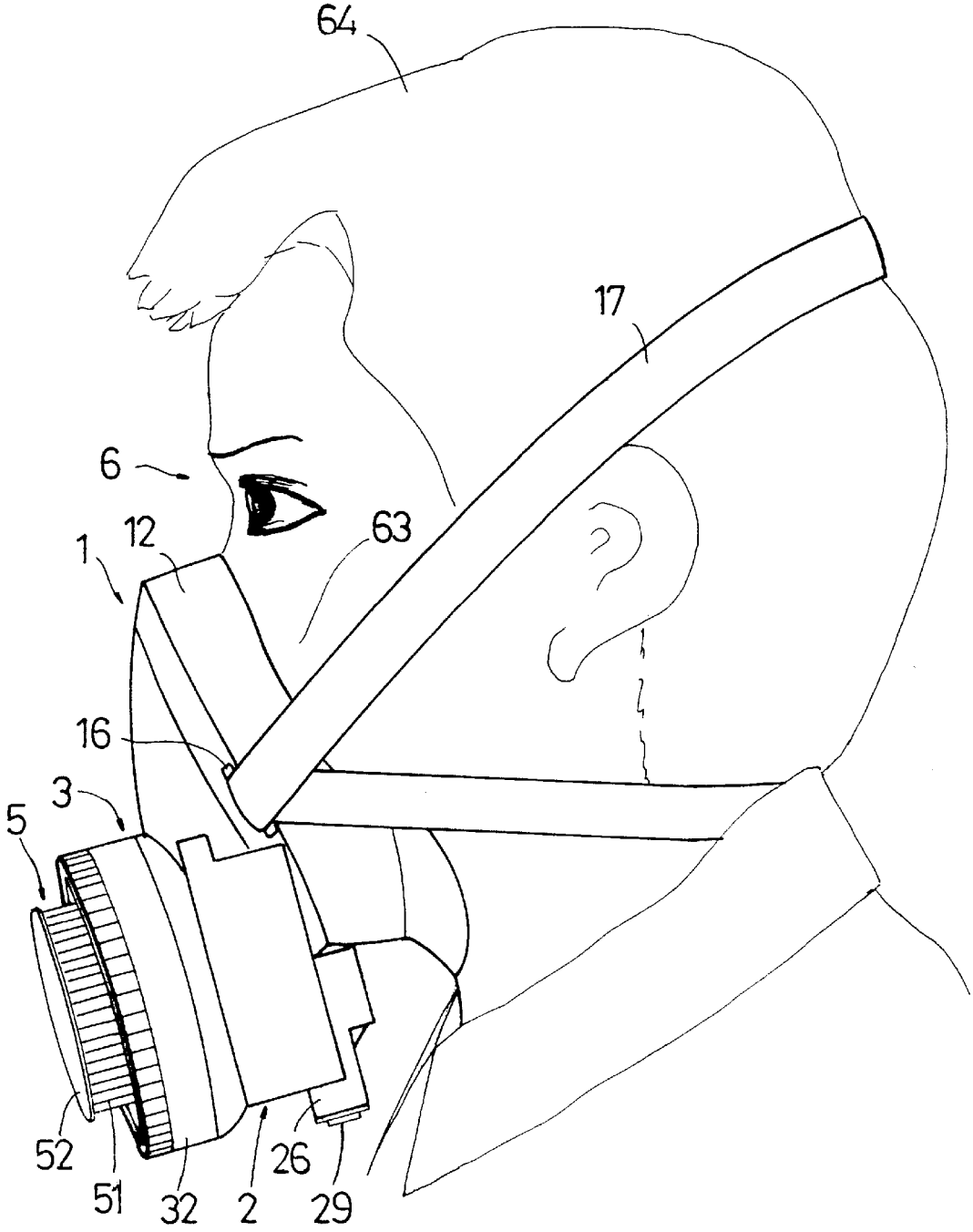
FIG. 4 shows the use of the present invention.
Figure 5:
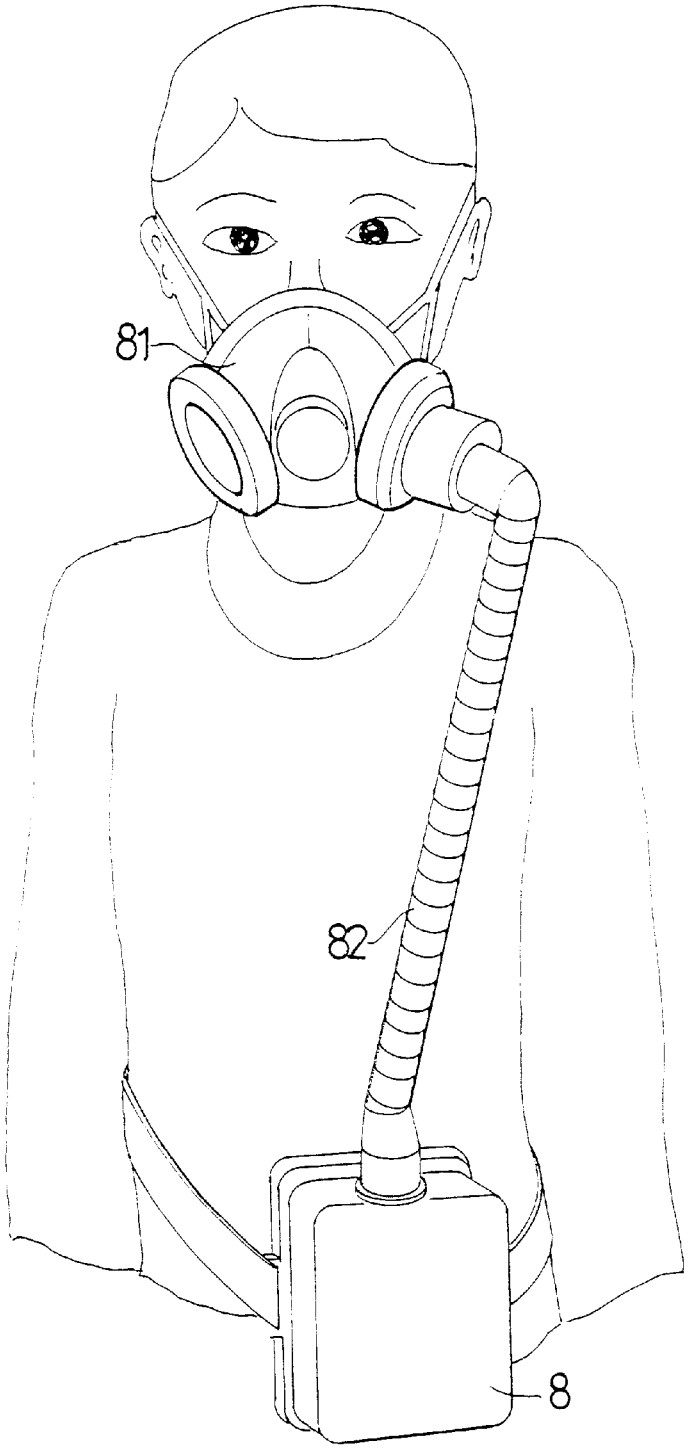
FIG. 5 PRIOR ART
FIG. 5 shows the use of a conventional gas mask.
Figure 6:
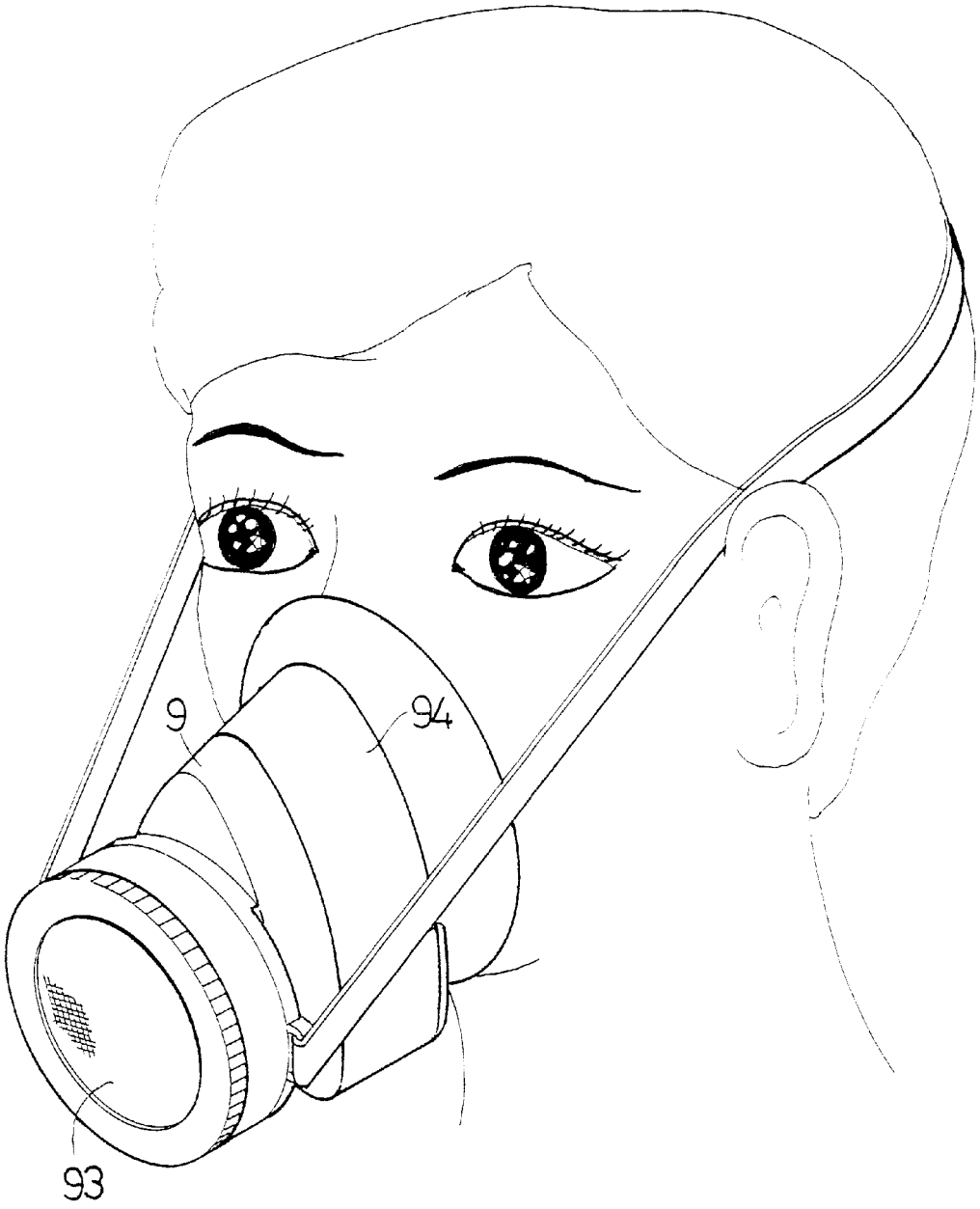
FIG . 6 PRIOR ART
FIG. 6 shows the use of another type of conventional gas mask.
Figure 7:
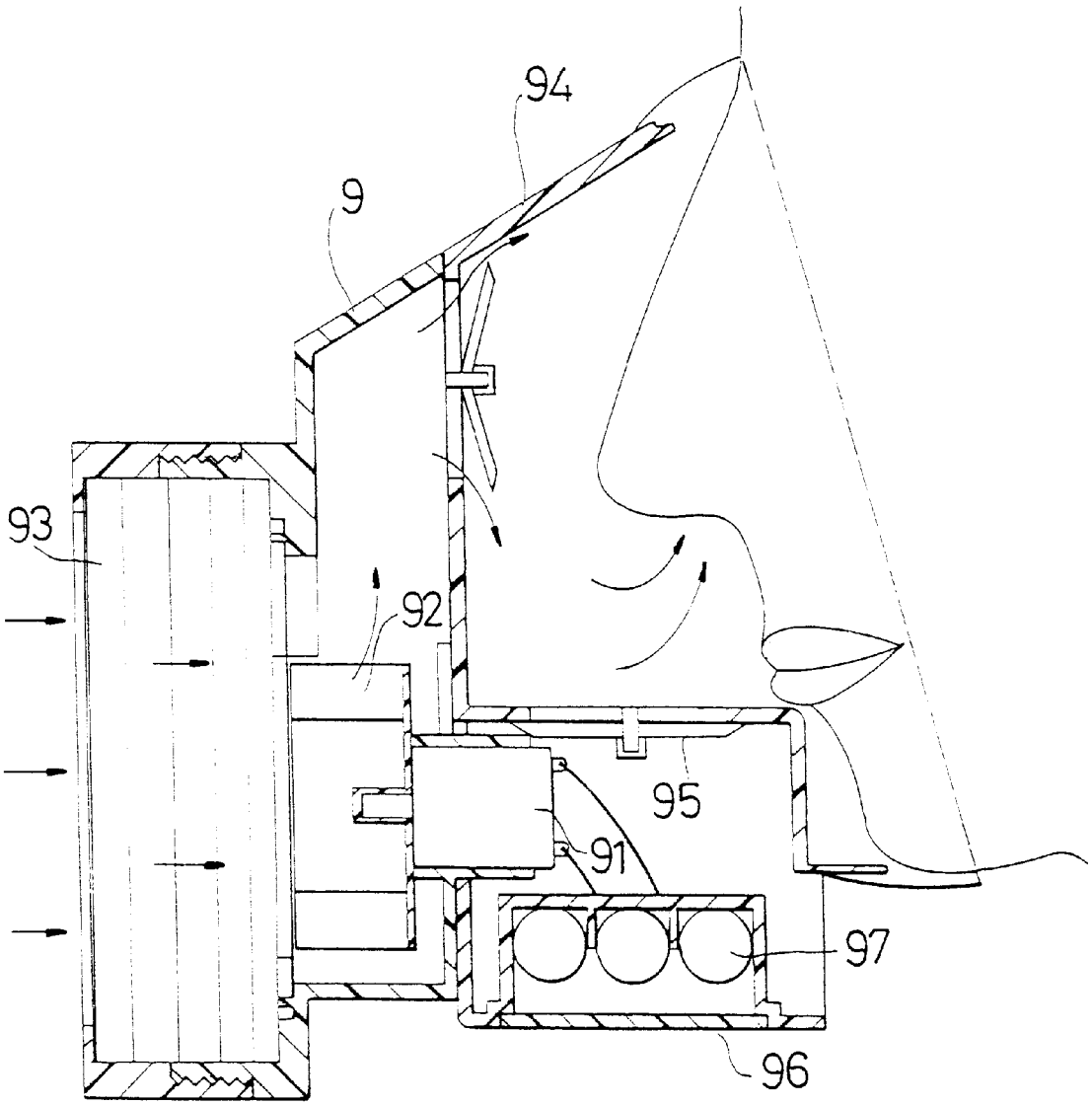
FIG · 7 PRIOR ART
FIG. 7 is a sectional view according to FIG. 6.

Referring to FIGS. 3 and 4, in use, two cells 24 are positioned upright into the receiving chamber 23 of each cell seat 2. A new filter body 4 is placed into the fixing seat 31 and the cover body 32. In the case that a user 6 works in a wood shp or a flour shop in which much powder is produced and tends to block the filter body 4, the user 6 can place the second filter body 5 in front of the filter body 4 and tightly screw the cover body 32 onto the fixing seat 31 to make the flange 321 hold the flange 53 of the second filter body 5. Then the user 6 can wear the gas mask over his/her nose and mouth with the sealing pad 12 tightly attaching to the user's face 63 without leakage. Then the user 6 winds the strap 17 around the user's head 64 and ties up the strap 17 and then switches on the switch 29. At this time, the motor 27 is powered on to operate for driving the fan 34 to suck in air. The air filters through the second filter body 5 and the filter body 4 and is purified from impurities and toxins. The cleaned air then flows into the rear cup body 1 for the user 6 to breathe.

The gas mask of the present invention has small volume and light weight and thus can be conveniently directly worn on the user's face 63 without affecting the movement of other parts of the body. It should be noted that the filter layer 51 of the second filter body 5 is made of cheaper unwoven fabric of folded fiber-made filter paper with good air-permeability and powder-impermeability. Therefore, the second filter body 5 is able to filter off the powder to prevent the filter body 4 from being blocked. As a result, the useful life of the filter body 4 in a powder laden working site is prolonged and the cost is reduced. In a working site without powder, the second filter body 5 is not needed.

In addition, the outlet 14 and the check membrane 15 of the rear cup body 1 are inclined so that the length of the rear cup body 1 is shortened. Also, the cell seats 2 on two sides of the rear cup body 1 are longitudinally directed so that the total length of the gas mask of the present invention is shortened. As a result, the torque of the filter body 4 at front end of the gas mask is reduced so that the user can more comfortably wear the gas mask without feeling heavy.

The above embodiment is only used to illustrate the present invention, not intended to limit the scope thereof. Many modifications of the above embodiment can be made without departing from the spirit of the present invention.

What is claimed is:

1. A gas mask structure comprising:

a rear cup body having opposing front and rear ends, the rear end having an opening formed therein for receiving a portion of a user's face therein, the opening in the rear end of the rear cup body having a peripheral portion with a soft rubber sealing pad affixed thereto, the front end of the rear cup body having a vertically directed guide way with an inlet opening formed at one end thereof in open communication with the opening of the rear end of the rear cup body, the front end of the rear cup body having an inclined wall portion with an outlet opening formed therethrough with a check membrane overlaying the outlet opening;

a pair of cell seats respectively disposed on opposing sides of the rear cup body and forming an air exit therebetween for discharging air from the outlet opening, each cell seat having a recessed receiving chamber for receiving at least one cell therein, each cell seat having an outer cover forming a closure for the recessed receiving chamber thereof;

a retaining seat disposed between the pair of cell seats and spaced from the air exit;

a motor disposed in the retaining seat and powered by cells within the pair of cell seats, the motor having a shaft extending into the guide way of the front end of the rear cup body;

a charging seat disposed in the retaining seat;

a power switch disposed in the retaining seat and for controlling power from the cells in the pair of cell seats;

a front cup body having opposing front and rear ends, the rear end of the front cup body being affixed to the front end of the rear cup body and having a through hole in open communication with the guide way, the front end of the front cup body being formed with a circular fixing seat;

a circular activated carbon filter body positioned in the fixing seat;

a ring-shaped cover body being releaseably coupled to the fixing seat, the cover body including an annular flange for retaining the activated carbon filter body within the fixing seat;

a second filter overlaying the activated carbon filter body, the second filter having a filter layer formed of one of an unwoven fabric or a folded fiber filter paper, the second filter having a protective cover on one end thereof and an annular flange on an opposing end, the annular flange of the second filter being captured under the annular flange of the cover body; and, a fan disposed in the guide way of the front end of the rear cup body in alignment with the through hole of the front cup body, the fan being coupled to the shaft of the motor to be rotatably driven thereby for generating an air flow through the second filter, the activated carbon filter body, the through hole of the front cup body, guide way and then through the inlet opening to be inhaled by the user.

2. The gas mask structure as claimed in claim 1, wherein the rear cup body has a pair of ear sections respectively disposed on the opposing sides thereof for respective connection with a strap.

3. The gas mask structure a claimed in claim 1, further including a charger having a plug for connection to the charging seat and recharging the cells in the cell seats.

* * * * *